United States Patent [19]

Gallagher et al.

[11] Patent Number: 5,005,101

[45] Date of Patent: Apr. 2, 1991

[54] METHOD AND APPARATUS FOR NEGATIVE CHARGE EFFECT AND SEPARATION OF UNDESIRABLE GASES

[76] Inventors: James C. Gallagher; Michael K. Gallagher, both of 105 Villa Ann, San Antonio, Tex. 78213

[21] Appl. No.: 304,275

[22] Filed: Jan. 31, 1989

[51] Int. Cl.[5] ..... H01J 3/04

[52] U.S. Cl. ..... 361/231; 361/225; 55/101; 323/903

[58] Field of Search ..... 361/225–229, 361/230, 231; 55/101, 102, 123, 150, 155; 323/903

[56] References Cited

U.S. PATENT DOCUMENTS

| | | | |
|---|---|---|---|
| 4,037,268 | 7/1977 | Gallagher | 361/231 |
| 4,109,290 | 8/1978 | Gallagher | 361/231 |
| 4,156,267 | 5/1979 | Spaulding et al. | 361/231 |
| 4,439,216 | 3/1984 | Perryman | 323/903 |
| 4,794,486 | 12/1988 | Black et al. | 361/231 |
| 4,860,149 | 8/1989 | Johnston | 325/903 |

*Primary Examiner*—A. D. Pellinen
*Assistant Examiner*—Jeffrey A. Gaffin

[57] ABSTRACT

An improved apparatus for generating a negative charge effect in the environment, in which opposite charged spaced electrically conductive plates are dielectric material. A relatively high alternating voltage is applied between alternate spaced plates with sufficient dielectric strength and dielectric constant to withstand the generation of a cold glow discharge or plasma, and withstand the deposit of dirt on them, and withstand exposure to corrosion, humidity, high temperatures, corrosive gases and fumes. A process is disclosed for the separation of undesirable gases and particulates in polluted areas or airstreams. The present invention relates to the excitation, dissociation, and breakdown of gases and other pollutants.

3 Claims, 5 Drawing Sheets

METHOD AND APPARATUS FOR NEGATIVE CHARGE EFFECT AND SEPARATION OF UNDESIRABLE GASES

BACKGROUND—FIELD OF INVENTION

This invention relates to an improved method and apparatus for producing electrons to give a negative charge to surrounding materials such as air, dust, building interiors, and to air moving systems. Also disclosed is an improved process for the separation of undesirable, i.e. $SO_2$, $NO_x$, CO, $CO_2$, and other undesirable gases.

BACKGROUND—DESCRIPTION OF PRIOR ART

A wide variety of methods and their apparatus have been used to either give a negative charge, or to separate undesirable gases. The categories for the methods and apparatus include small ionizers, electrostatic precipitators, or the use of scrubbers or plasma generators. Most end users appreciate the different systems, and would prefer to combine the best features and results of all of these methods and apparatus.

One of our co-inventors had a previous application entitled METHOD AND APPARATUS FOR GENERATING A NEGATIVE CHARGE IN AN ENVIRONMENT. Ser. No. 557,869, filed Mar. 12, 1975, now U.S. Pat. No. 4,037,268. Another previous application by the same inventor was an improved means entitled MEANS FOR GENERATING A NEGATIVE CHARGE, Ser. No. 788,118, now U.S. Pat. No. 4,109,290. These were both a method and apparatus disclosed for producing electrons to give a negative charge to surrounding materials, environments, and to air and gases.

While the device worked, one disadvantage is that if the device were operated improperly, or if the dielectric used was slightly less perfect than the materials maximum potential, or especially if the surface had uneven characteristics, ozone could be generated. A second disadvantage is that a large number of dielectric covered electrodes were required for the systems maximum performance. A third disadvantage is the mandatory use of the sealed chamber described in U.S. Pat. No. 4,109,290. A fourth disadvantage is the potential for arc or sparkover, as they are known in plasma physics. A fifth disadvantage is that small amounts of dust and moisture, or exposure to fumes, mists, or corrosive gases and similar deposits, could cause arcing or sparkover and dielectric breakdown. A sixth disadvantage is that the sealed chamber decreased the available power, and did not allow for the electrodes to directly interact with air and gases. A seventh disadvantage is that the sealed chamber suffered from wall effects, as it is commonly known in plasma physics, and the chamber caused the internal gas or gases to heat beyond desirable levels.

One item of interest is that U.S. Pat. No. 4,477,263 cites the first patent listed above, and states that an alternating current system for ionization has not proven satisfactory for use in a large clean room or manufacturing area. Many ionization systems have been patented, but all apparently are limited by an ionizer systems characteristics and require emitters installed throughout a large area. Ionization systems are well known as having a limited result in reducing undesirable and polluted gases in the concentration and volume found in industrial manufacturing areas. Patents in this field include U.S. Pat. Nos. 4,366,525, 4,388,667, 4,435,195, 4,440,553, 4,473,382, 4,484,249, 4,498,116, 4,502,091, 4,517,621, 4,626,265, 4,630,167, 4,642,728, 4,652,281, 4,662,903, 4,672,504, 4,689,715, 4,713,724 and 4,715,870.

Several processes and types of apparatus have been proposed to produce an oxygen enriched or gas separation air product. These are commonly known as scrubbing systems. Many separation or scrubbing systems are described in a patent entitled U.S. Pat. No. 4,702,757 DUAL AIR PRESSURE CYCLE TO PRODUCE LOW PURITY OXYGEN. Another system is U.S. Pat. No. 4,702,750 entitled PROCESS FOR SEPARATING UNDESIRABLE COMPONENTS FROM GASEOUS MIXTURES.

Conventional air cleaning systems usually have a number of disadvantages. They may include any or all of the following: expensive to purchase, expensive to maintain, difficult to install and maintain, may produce ozone, or require higher than desired use of energy for operation.

Conventional air cleaning systems are generally considered expensive or are not fully effective. Two examples of prior art are submitted here. The U.S. Environmental Protection Agency and the Tennessee Valley Authority jointly reported in 1981 that several examples were very expensive in the testing reported. This report was entitled EVALUATION OF THE ADVANCED LOW-$NO_x$ BURNER, EXXON, AND HITACHI ZOSEN PROCESSES. The Abstract includes capital investment costs for the systems ranging from $9.9 million to $32.1 million, and levelized annual revenue requirements for the same systems were as high as $8 million.

The second example is supplied by both the U.S. Environmental Protection Agency and the Department of Energy. Both issued program solicitation in the fall of 1988 under the Small Business Innovation Research programs. The EPA program solicitation on page 21 states that existing $SO_2$ and $NO_x$ emission control measures are generally expensive or are not fully effective. Page 22 of the same report states that this requires new, innovative and cost-effective approaches, and that that innovation is needed to develop new ways to deal with air pollution control problems.

The U.S. Department of Energy program solicitation stated on pages 70 through 76 that they desire innovative research for control of emissions and environmental problems. Page 75 in particular, calls for innovative concepts to allow more efficient, economical and acceptable control of emissions of $SO_2$, NO, $NO_2$, $N_2O$, and fine particulates.

OBJECTS AND ADVANTAGES

Accordingly several objects and advantages of our invention are: to provide a method and apparatus for easily, reliably, efficiently, and relatively inexpensively produce a negative charge effect and separation of many undesirable gases.

In addition the following additional objects and advantages is to provide an apparatus that is easier to assemble, use, repair, and adjust for modified results, than either U.S. Pat. Nos. 4,037,268 or 4,109,290, and readers will appreciate the obvious advantages over prior systems for air purification that are limited to control of either particulates or gases but not both.

Further objects and advantages of our invention will become apparent from a consideration of the drawings and ensuing description of it.

LIST OF REFERENCE NUMERALS

Figure 1:
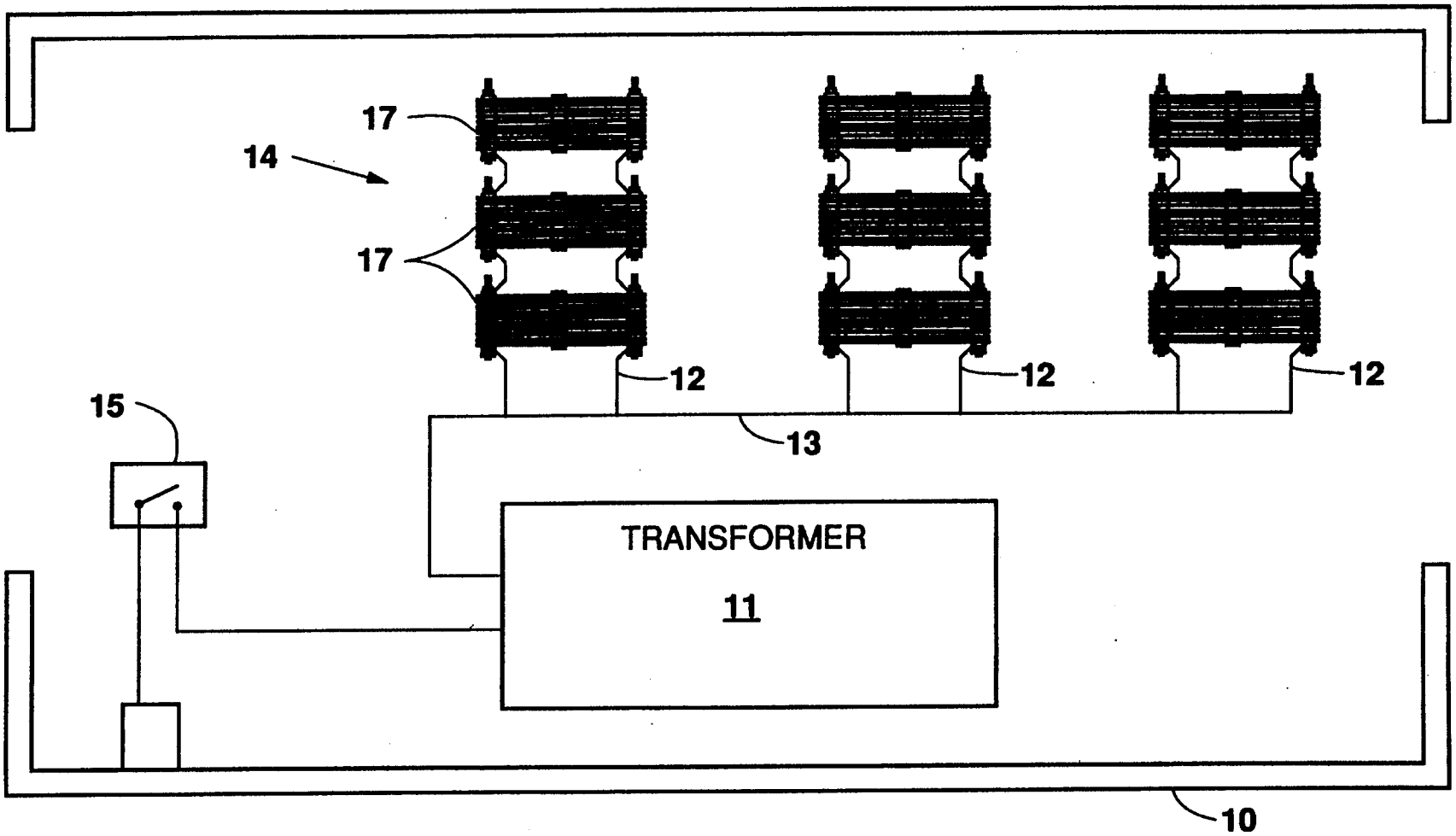
FIG. 1 is a plan view of one form of apparatus incorporating our invention such as might be used in a small area.
Figure 2:
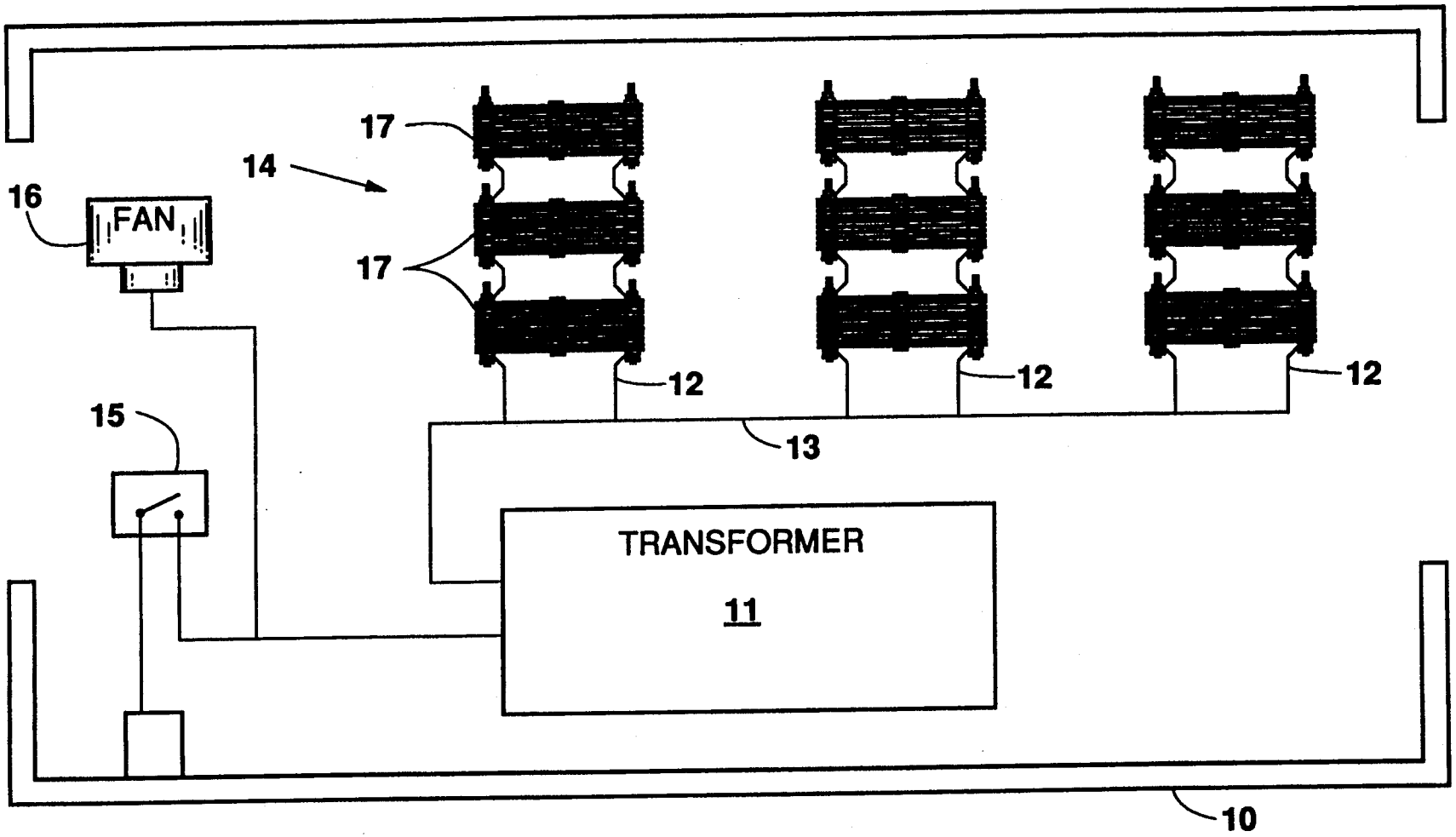
FIG. 2 is a plan view of the apparatus with an optional fan or blower, such as might be used in a small area.
Figure 3:
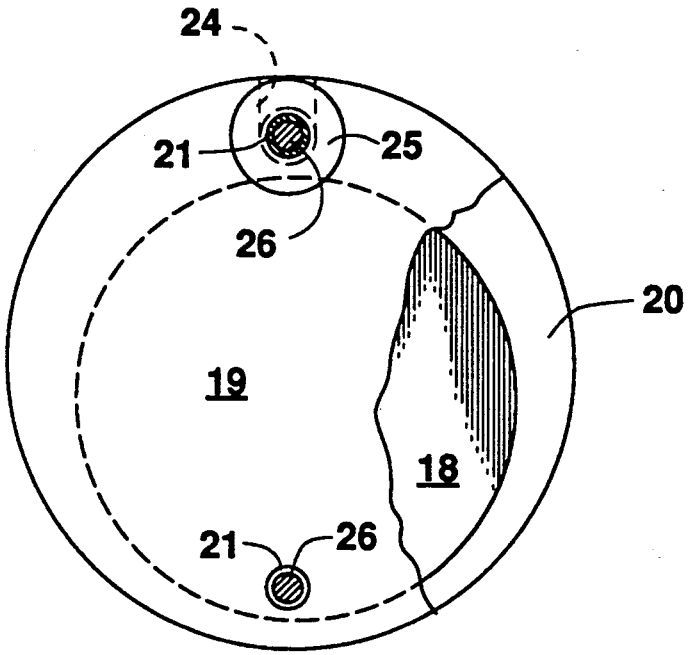
FIG. 3 is an elevational view of the individual electrode unit of the generator of our invention, the electrode unit being partially broken away to show the contained electrically conductive plate.
Figure 4:
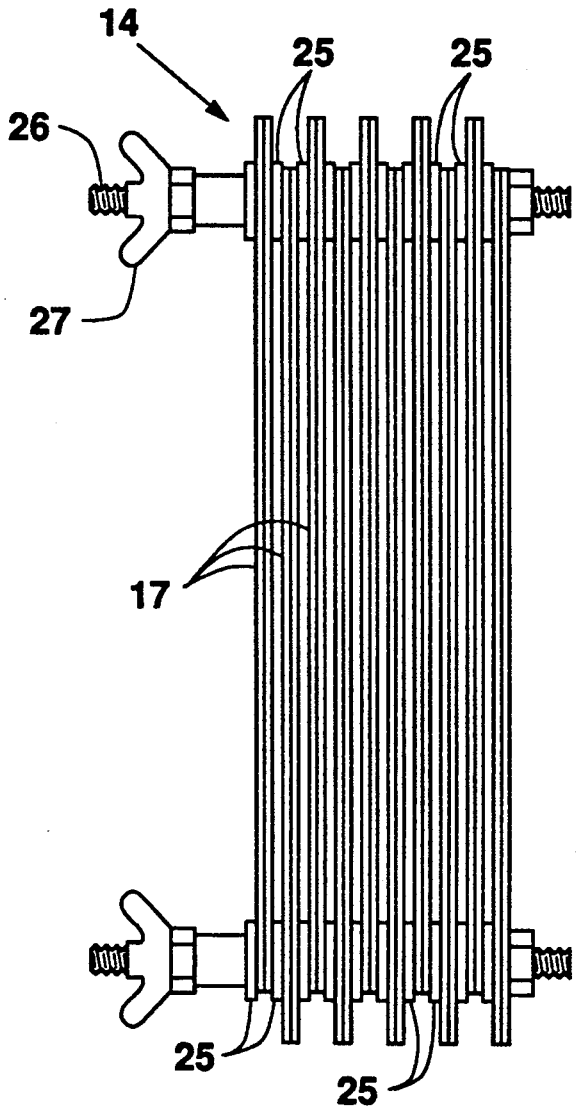
FIG. 4 is a side elevational view of a plurality of stacked electrode units.
Figure 5:
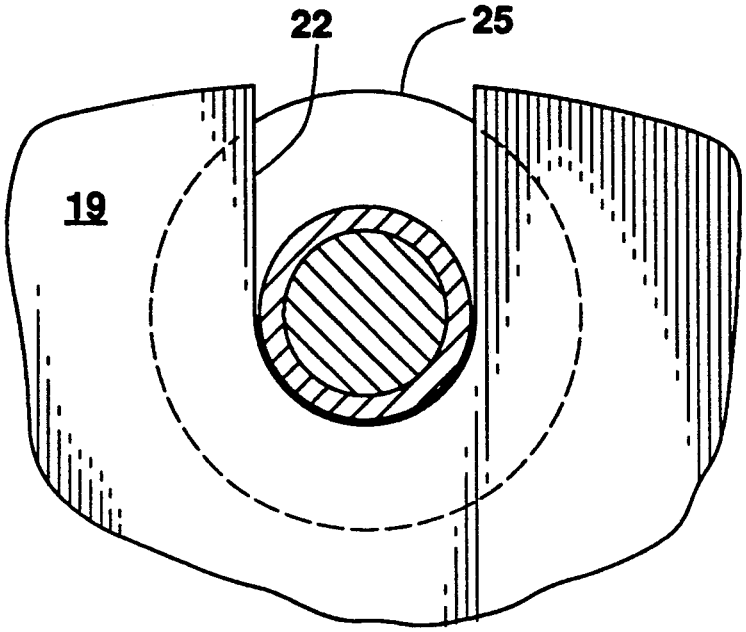
FIG. 5 is a fragmentary view of a portion of an electrode unit showing an assembly notch in an electrode unit with its associated insulating washer shown in phantom.
Figure 6:
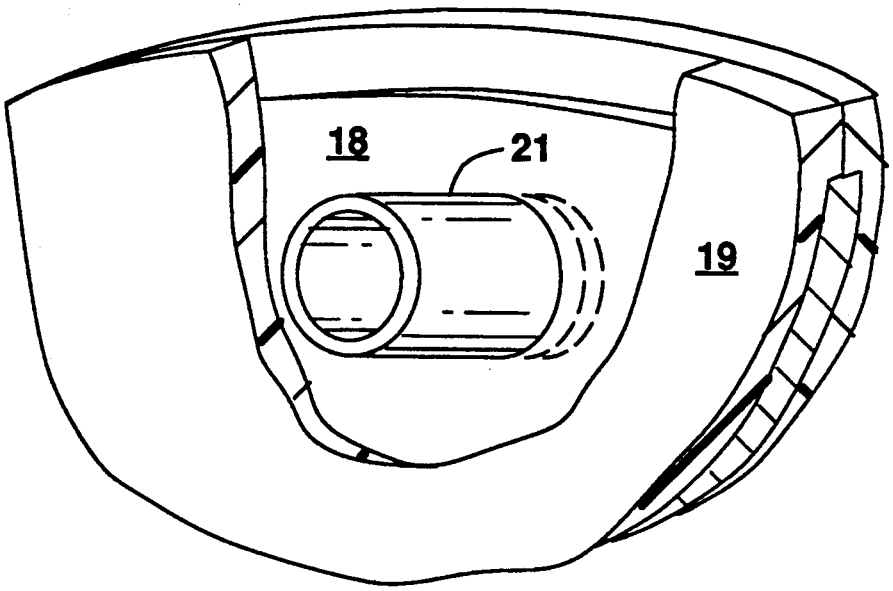
FIG. 6 is a fragmentary perspective view of a portion of an electrode unit showing interconnecting spacer construction.

10: platform
11: transformer
12: output terminals, of transformer
13: high-voltage insulated wire
14: electrical discharge generator
15: switch, power control
16: blower or fan
17: electrode units
18: electrically conductive plate
19: dielectric layer
20: flexible silicone adhesive
21: electrically conductive spacer
22: opening in dielectric plate
23: hole in the plate
24: notch in edge of dielectric plate
25: dielectric washer
26: assembly threaded rod
27: threaded nuts for rod (can be wing-type)

DESCRIPTION OF THE PREFERRED EMBODIMENT

Referring now to the drawing, FIG. 1 shows a commercially practical negative charge and gas separation unit, the numeral 10 indicates generally a platform, such as a metal mesh or grid. A high voltage transformer 11 has its output terminals 12 connected through high voltage insulated wire 13 to a plurality of electrical discharge generators 14. The electrical discharge generator 14 combines a plurality of stacked, spaced, disc-like units 17 and is mounted on the platform 10 so that the air or gas can flow through the stacked electrode units 17. The transformer 11 steps up 60 cycle A.C. line voltage to a relatively high A.C. voltage which is applied between alternate electrode units 17 of the electrical discharge generator 14. As is shown in FIG. 1 a switch 15 controls the power to the transformer 11.

The maximum secondary voltage developed by the transformer 11 of the preferred embodiment illustrated is approximately 15,000 volts RMS. The electrical discharge generators 14 of the present invention is generally illustrated in FIGS. 3–6. Each electrode unit 17 of the generator 14 generally comprises a disc-like electrically conductive plate 18 covered on either side by a layer of dielectric material 19. For some dielectric materials, the plate 18 may be encapsulated in the material. In the illustrated embodiment, the covering layers 19 are formed into a somewhat larger disc with the plate 18 eccentrically aligned between the sheets with an adhesive 20 such as a clear silicone. To provide a means for electrically interconnecting alternate electrode units 17 in a stack, one end of a tubular, electrically conductive spacer 21 is physically and electrically connected to one side of the plate 18 through an opening 22 in the covering layer of dielectric material 19. The end of the spacer 21 fits into a hole 23 in the plate 18 near the edge of the electrode unit 17 where the plate is nearest the edge. The spacer 21 is securely fastened to the plate 18 for good electrical contact.

A notch 24 is cut in the edge of the electrode unit opposite the spacer 21 for receiving a grommet type dielectric washer 25. The notch 24 is not deep enough into the edge to cut into the plate 18.

When the individual electrode units 17 are assembled into an electrical discharge generator 14 each spacer 22 passes through the insulating washer 25 of an adjacent electrode unit 17 and makes contact with the plate 18 and spacer 21 of the next adjacent electrode unit 17 so that alternate electrode units 17 are electrically interconnected.

An assembly threaded rod 26 passes through the aligned spacers 21 and the threaded exposed ends of the rod are fitted with threaded nuts 27. The result is a tubular electrical bus providing good electrical contact between alternate plates 18 to prevent high voltage arcing around the interconnections between alternate electrode units 17.

GLOW DISCHARGES

In a glow discharge several radiative, two-body, and three-body recombination mechanisms are recognized. Those occurring at greatest speed are the dissociative recombination of electrons and positive molecular ions such as illustrated by $$NO^{+}+e\ N+e$$

whereby the products may be electronically excited.

Taking hydrogen as an example, and denoting p and q the principal quantum numbers of the state of the hydrogen atom, a number of recombinations can take place, such as:

$$H^{+}+e+e \rightarrow H(p)+e$$

and the inverse collisional ionization $$H(p)+e \rightarrow H^{+}+e+e$$

superelastic collisions $$H(p)+e \rightarrow H(p)+e\ (q<p)$$

inelastic collisions $$H(p)+e \rightarrow H(q)+e\ (q>p)$$

downward cascading $$H(q) \rightarrow H(p)+hv$$

radiative recombination $$H^{+}+e \rightarrow H(p)+Hv$$

and photoionization $$H(p)+h\nu \rightarrow H^{+}+e$$

Ion-ion recombination reactions, as well as three-body recombinations such as the following are encountered in a glow discharge.

$$NO^{+}+NO_2+M \rightarrow \text{neutral products}$$

The energy of hydrogen atoms is too high to permit recombinations on collision. To remove this energy a third body must be present. Therefore such recombinations can occur on the walls of the reactor vessel. Traces of water vapor are also found to enhance the rate of homogeneous recombinations, such as:

$$H+O_2+M \rightarrow HO_2+M$$

$$H+HO_2 \rightarrow H_2+O_2$$

or $$H+HO_2 \rightarrow H_2+O_2$$

or $$H+HO_2 \rightarrow 2OH$$

or $$H+HO_2 \rightarrow H_2+H$$

and transfer reactions of the type:

$$H+H_2 \rightarrow H_2+H.$$

Transfer reactions of H and D atoms with hydrocarbon:

$$CH_4+H \rightarrow CH_4+H$$

and $$CH_4+D \rightarrow CH_3D+H$$

have been found to take place above 200° C.

Hydrogen has also been found to react with compounds of carbon, hydrogen, and oxygen in a variety of ways including:

$$H+HCOOH \rightarrow H_2+COOH$$

and $$H+CH_3OH \rightarrow H_2+CH_2OH$$

and $$H+CH_3CHO \rightarrow H_2+CH_3CO$$

and $$H+CH_3CO \rightarrow CH_3+CHO$$

$$H+CH_3CO \rightarrow CH_4+CO$$

and so forth.

OXYGEN IN A GLOW DISCHARGE

Since molecular oxygen is an electronegative gas it forms stable negative ions. A very large body of work is available on oxygen discharges. The oxygen plasma is a three-component plasma consisting of three types of charge carriers:

Electrons
Positive ions
Negative ions

In the glow discharge the predominant positive ion is the $O_2^{+}$ with minor quantities of $O^{+}$.

Electronic excitation

This is described by three processes with thresholds at 4.5, 8.0, and 9.7 eV. The latter two are expected to lead to dissociation. At an average electron energy of 3.0 eV the effective dissociation rate constant is approximately $$2\times10^{-9}\ \text{cc mole}^{-1}\ \text{sec}^{-1}.$$

In pure $O_2$, as in $N_2$, there exists another loss term not observed in $H_2$. The polyatomic ions $O_3$ and $O_4$ can react exothermically via $$O_4^{+}+O \rightarrow O_3^{+}+O \rightarrow O_2^{+}+O_2$$

to recombine O atoms.

Hydrocarbons may be attacked in glow discharges by O atoms via different reactions such as Hydrogen abstraction
Addition to double bond
Entry into C—H or C—C bond Hydrogen abstraction appears to be dependent on temperature. Thus, for example, $CH_4$ will be oxidized to the extent of only 1% at room temperature, but to 6% at 190° C. or higher.

Ethane, butane, benzene, and tolune react more than a hundred times slower than olefins. The initial reaction step is believed to be $$O+CH_4 \rightarrow OH+CH_3$$

followed by the fast reactions between O and radicals.

In reactions of O and organic compounds containing oxygen it is generally found that they yield CO, $CO_2$, $H_2O$, and $H_2$. Hydrogen abstraction appears to be the first step of attack on compounds composed of C, H, and O. Carbon and carbonaceous substances react readily with oxygen at activation energies of about 10 Kcal/mole in the temperature range of 14°-200° C.

Dominant +ionization, loss attachment and detachment processes in oxygen discharges include:

$$e+O_2^{*} \rightarrow O_2^{*}+2e$$

$$e+O_2 \rightarrow O_2^{+}+2e$$

$$e+O \rightarrow O_2^{+}+2e$$

$$N^{-}+\text{electrode} \rightarrow N+e$$

Attachment $$e+O_2 \rightarrow O+O^{-}$$

$e+O_2^{*}\rightarrow O+O^-$ $e+2O_2\rightarrow O_2^-+O_2$ $e+O_2^{*}\rightarrow O_2^-+O_2$ Nonattachment losses $e+O_2^+\rightarrow 2O$ $e+O_2^++M\rightarrow O_2+M$ $e+N_2+\text{wall}\rightarrow N$ $e+N^++\text{electrode}\rightarrow N$ Detachment $e+O^-\rightarrow e+O_2$ $O^-+O_2^{*}\rightarrow O_3+e$ $O_2^-+O\rightarrow O_3+e$ $O_2^-+O_2^{*}\rightarrow 2O_2+e$ Source: J. W. Dettmer, Ph.D. Dissertation, Air Force Institute of Technology, 1978.

GLOW DISCHARGES AND DIATOMIC GASES

Ionization potentials known for many free radicals can be used for the calculation of bond dissociation energies when the appearance of potential of the ionized free radicals can be measured.

The appearance potential is equivalent to the heat of the reaction. The ionization is equivalent to the heat of the reaction $e+RH\rightarrow R^++H+2e$ $R\rightarrow R^++e$ The heat of the reaction is obtained by combining:

$RH\rightarrow R+H$

Electron impact studies for a number of simple molecules have resulted in bond energy values that are in good agreement with values obtained from other methods.

The dissociations have led to assumptions that bond energy values derived from thermochemical data can frequently be applied in the formation of free radicals. Free radicals have been produced in glow-discharge plasmas. The energy required lies well within the range of that existing in such plasmas.

In this way calculations have provided data for the formation of ions of the type ($CH_3^+-X$) and for ions resulting from the removal of more than one atom from the molecule. Since energies of a large number of bonds rare exceeds 5 eV, a sizeable number of various free radicals with some ions is expected to occur in glow discharges.

FREE RADICALS IN GAS DISCHARGES

A wide variety of free radicals are formed in gas discharges. Those identified include CH, OH, CN, CS, R—CH, CNO, CNS, CF, $CF_2$, $C_6H_5$, $NH_2$, PH $PH_2$, SH, $S_2H$ and others.

Free radicals are also generated in a glow discharge from gas mixtures. For example, NH can be found in nitrogen and hydrogen mixtures, or OH in oxygen in hydrogen mixtures.

The energies required for such free-radicals are easily found in the higher eV ranges, including higher power gas discharges. For simple radicals the collisional efficiency of recombination is typically close to unity. Nearly every collision will result in recombination.

A free radical is most often formed from gas molecules by the abstraction of an atom. A common example is the breaking of an H atom from hydrocarbons. Other examples include the abstraction of halogen, sulfur, and oxygen from their molecular bodies, producing radicals including $CH_3$, $C_2H_5$, $CCl_3$, CS, and OH.

TABLE

Energies in a glow discharge versus typical bond energies.

| ENERGY | eV |
|---|---|
| In glow discharge | |
| Electrons | 0–20 |
| Ions | 0–2 |
| Metastables | 0–20 |
| UV/visible | 3–40 |
| In bond | |
| C—H | 4.3 |
| C—N | 2.9 |
| C—Cl | 3.4 |
| C—F | 4.4 |
| C=O | 8.0 |
| C—C | 3.4 |
| C=C | 6.1 |

Source: A. V. Engel, Ionized Gases, Oxford University Press: Oxford (1955)

Various gases and their Excitation Potential energy, energy of Dissociation, and Ionization potential energies. Shown in eV.

| GAS | EXCITATION POTENTIAL | DISSOCIATION ENERGY | IONIZATION POTENTIAL |
|---|---|---|---|
| $H_2$ | 11.47 | 4.48 | 15.422 |
| $O_2$ | 1.635 | 5.115 | 12.2 |
| $N_2$ | 5.23 | 9.762 | 15.576 |
| $O_3$ | | 6.17 | |
| NO | 5.38 | 6.507 | 9.25 |
| CO | 6.04 | 11.111 | 14.00 |
| $CO_2$ | 10.0 | 5.46 | 13.7 |
| $H_2O$ | 7.60 | 9.511 | 12.6 |
| $CL_2$ | 2.27 | 2.481 | 13.2 |
| $Br_2$ | 1.71 | 1.97 | 13.3 |
| $I_2$ | 1.472 | 1.542 | 9.0 |
| $N_2O$ | | | 11.0 |
| OH | 4.06 | 4.45 | 12.9 |
| HCL | 9.62 | 4.40 | |
| $SO_2$ | | | 12.1 |

THE COEFFICIENT OF IONIZATION BY ELECTRON COLLISION, $\alpha$

To determine the number of electrons consider a slab at a distance x from the cathode and having a thickness dx. If n electrons are entering this slab after a distance dx, dn new electrons are produced where dn must be proportional to n and to dx.

The constant of proportionality is the number of ionizations per length, $\alpha$. Therefore, $$dn = \alpha n dx \quad (1)$$

If at s=o, $n=n_o$, the number of electrons emitted from cathode we have $$In \frac{n}{n_o} = \int_o^x \alpha dx \quad (2)$$

In the uniform field, $\alpha$ is independent of x and the right-hand side of the above is therefore equal to $$\alpha \int_o^x \alpha dx = x \quad (3)$$

The above becomes $$n = n_o \epsilon^{\alpha x} \quad (4)$$

Since the drift velocity depends only on $\epsilon$ and is therefore independent of x, i, the current measured by placing the anode at various distances is $$i = i_o \epsilon^{\alpha x} \quad (5)$$

Since the electron drift velocity is constant, $i_o$ is a result of the primary emitted from the cathode and is called the Photocurrent.

By measuring i and $i_o$ we can determine $\alpha$. This is usually done by changing d, the electrode separation. Also, one can measure the current i at each d. Plotting the ratio of i to $i_o$ on a logarithmic scale versus d should yield linear relationships since from the second formula of this section at $d=d_1$ $$\alpha d_1 = In \frac{i_1}{i_o} \quad (6)$$

and $$1 = \frac{1}{d_1} In \frac{i_1}{i_o} \quad (7)$$

and $$\frac{1}{d_1} (Ini_2 - Ini_o) \quad (8)$$

and from which it follows that $$Ini_o = \frac{d_2 Ini_1 - d_1 Ini_2}{d_2 - d_1} \quad (9)$$

The current $i_o$ is produced by the radiation incident on the cathode is is reffered to as photocurrent. Increasing the distance and/or voltage between the plates or electrodes will lead to an overexponential rise in current that is used in measuring the second Townsend ionization coefficient for breakdown.

When $n_o$ electrond start at the plane cathode we expect n electrons at the opposite parallel plane of the anode, with n given by $$n = n_o \epsilon^{\alpha d} \quad (10)$$

with d as the separation of the two parallel planes of cathode and anode.

If only one electron starts at the cathode, then $\epsilon^{\alpha d}$ electrons will arrive at the anode. Above the onset of ionization by electron collision, it has been shown that $\alpha/p$ where p is the pressure measured in torr, axxumes values that start in the order of $10^{-3}$ ionizations/dm-torr.

At moderate E/p of less than 100 V/cm-torr, $\alpha/p$ of some $10^{-1}$ ionizations/cm-torr is readily reached. Considering a parallel plate electrode arrangement in atmospheric air having a 1.0 cm spacing d will be in the order of 7.6 and $\epsilon^{\alpha d} = 2 \times 10^3$ electrons.

Thus one electron starting at the cathode brings about 2,000 electrons at the anode. This phenomenon is commonly called electron avalanche.

IONIZATION COEFFICIENT $\alpha$ ALTERNATING FIELDS

When an electric field of an increasing frequency is applied to a gas, the motion of electrons is similar to the motion under dc field as long as the frequency is less than a few $10^3$ Hz.

If $v_i$ is defined as the ionization rate per unit time, or ionization frequency, it is evident that $$v_i = \alpha v_d \quad (11)$$

where $\alpha$ is the first Townsend coefficient of ionization by electron collision, and $v_d$ is the drift velocity of electrons.

Using for a while the electron mobility $k^-$, which is equal to $v_d/E$, $$v_i = \alpha k^- E \quad (12)$$

and by using the ionization efficiency $\eta$, we have $$v_1 = \eta k^- E^2 \quad (13)$$

since $\eta = \alpha/E$ by definition. Rewriting the above, $$\eta = \frac{v_1}{k^- E^2} \quad (14)$$

If $v_d$ is known it is possible to deduce $\alpha$ from the measurement of $v_1$ and vice versa.

PROCESSES IN THE GAS

A second generation of electrons can be produced in the gas without the assistance of the electrodes.

Photoionization of a gas can occur below the threshold of ionization potential. This can occur because of different and indirect and step processes leading from excited states to reactions between the various atoms and molecules with ionization as a result. Impurities, metastables, molecular processes and the Penning effect play roles in producing electrons by photoionizations.

When the first generation of electron avalanches passes over to the anode, not only will excited states be found but also dissociation of molecular gases, such as $H_2$ and $N_2$ whose dissociation energies are 4.36 and 9.6 V. This is much lower than their ionization energies. Therefore, it is very often possible that the excited states of one form can ionize the other form. In all gas mixtures or impure gases the photoionization energy of one component can be less than the excitation energy of another.

To find an expression for the number of electrons reaching the anode and for the anode current assume that the majority of ions are produced in the last two to three ionizing free paths in front of the anode. The axxumption is justified when $1/\alpha$ is much smaller than the electrode separation.

If $\theta$ is the number of excited states or photons created per unit length in field direction per electron, then the ratio $$f = \frac{\theta}{\alpha} \tag{15}$$

gives the proportion of excited to ionized states.

If n electrons arrive at the anode they will be composed of two constituents. 1. The electrons due to multiplication of the initially externally produced no electrons whose number at the anode becomes $$n_o\epsilon^{\alpha d}. \tag{16}$$

2. p electrons due to photoionization in the gas from excited states of the same or of different species.

Therefore, one finds $$n = n_o\epsilon^{\alpha d} + p \tag{17}$$

Under the above assumption a great proportion of all electrons and excited states are created in the anode vicinity. The number of photons to be emitted from the excited states, after a lapse of their very short lifetime of $10^{-8}$ to $10^{-13}$ second, is given by $$n\theta/\alpha \tag{18}$$

Only a fraction of these photons will be heading towards a slab of thickness $d_y$ and at a distance y from the anode. If we use a geometrical factor g which specifies the fraction of photons, it is evident that g must be a function of y. If the plane of the electrode is round and has a radius r, g can be estimated from the equation $$g = 0.5\left(1 - \frac{y}{\sqrt{r^2 + x^2}}\right) \tag{19}$$

The attenuation of the photon beam by absorption within the slab can be determined so that 1, the number of photons at any distance y, is given by $$I = I_o\epsilon^{-\mu y} \tag{20}$$

where $I_o$ is the initial beam density and $\mu$ is the absorption coefficient.

$I_o$ may be estimated from the above assumption and most electrons are produced near the anode. The number of excited states is fn and the number of photons heading toward the slab is $$I_o = gfn \tag{21}$$

The number of photons lost by gas absorption in the slab is $$dI = I_o\epsilon^{-\mu y}dy \tag{22}$$

This will cause excitation and/or ionization of the absorbing molecules or atoms. They might also lead to dissociation of molecules with or without excitation of the products.

Only a portion of these dI photons will be able to produce photoelectrons. If the ratio of ionizing photons to the total number of absorbed photons is designated $\xi$, the number of photoelectrons produced in the slab will be given by $$dI = I_o\xi^{-\mu y}dy$$

or $$= \xi gfn\,\epsilon^{-\mu y}dy$$

by substituting gfn for $I_o$. These photoelectrons will be accelerated by the electric field and form electron avalanches exactly as the initial $n_o$ electrons did.

This contribution of the total electron number p due to secondary effects in the gas is dp, and hence, $$dp = \xi\mu gfn\epsilon^{-\mu y}dy \cdot \epsilon^{\alpha y} \tag{25}$$

$$= \xi\mu gfn\epsilon^{y(\alpha-\mu)}dy \tag{26}$$

p can then be determined by integrating the above expression from y=0 to y=d. Thus $$p = \xi\mu gfn \int_o^{y=d} \xi^{y(\alpha-\mu)}dy \tag{27}$$

$$= \xi gfn \frac{\mu}{\alpha - \mu}\left[\xi^{(\alpha-\mu)d} - 1\right] \tag{28}$$

By substituting we get for the total number of electrons reaching the anode, $$n = n_o\epsilon^{\alpha d} + \xi gfn \frac{\mu}{\alpha - \mu}\left[\epsilon^{(\alpha-\mu)d} - 1\right] \tag{29}$$

and by rearranging, $$\frac{n}{n_o} = \frac{\epsilon^{\alpha d}}{1 - \xi gf\frac{\mu}{\alpha - \mu}\left[\epsilon^{(\alpha-\mu)d} - 1\right]} \tag{30}$$

This equation also represents the ratio $i/i_o$. It has the same form as that for secondary emission of electrons by gas-produced photons, striking the anode, although the secondary mechanism is entirely different.

BREAKDOWN UNDER ALTERNATING FIELDS

When a neutral gas is subject to a sinusoidally varying field the ionization processes can differ from those under dc fields. The type of gas or gas mixtures and its pressure play an important role, as in the dc field. The new variable is the frequency with which the field is pulsating.

When the frequency of the applied field is very small the polarity of the electrodes will be changing very slowly. Because the breakdown of the gas or gases is completed in intervals between $10^{-6}$ to $10^{-8}$ seconds the alternating voltage will not have enough time to reverse the direction of the electric field once the process has begun.

The mechanism is essentially as that of the dc fields. The ionization will be subject, now, to a slowly varying field. If the voltage magnitude is such that during the voltage peak the onset conditions are reached, then the the electron avalanches will be produced in the same way as under the constant field.

Using a frequency of 60 Hz the period of time between field polarity reversals is 8.33 msec. This is more than sufficient to clear the gap of any charge residues from the preceding half-cycle.

To determine the maximum size of the gap in which this is possible one must calculate the distance the ions move under such conditions. The alternating field is E, and is described as $E_o \cos \omega t$. The mobility of the positive ions is $k^+$. The distance the positive ions will travel before the voltage reverses at $t'=T/4$, then $$x = \int_o^{t'} k^+ E dt \quad (31)$$

$$= \int_o^{t/4} k^+ E_o \cos \omega t \, dt \quad (32)$$

$$= \frac{k^+ E_o}{\omega} \quad (33)$$

$$= \frac{k^+ E_o}{2\pi f} \quad (34)$$

Under atmospheric breakdown conditions in air this distance is approximately equal to 120 cm.

This does not mean that the accumulation of positive space charge will occur at larger distances because of polarity reversal the positive ions have a full half cycle, T/2, to reach the new cathode.

Finding a critical distance can be very important, and in high frequency applications it is also possible to determine the maximum frequency under which positive ion clearance in a quarter cycle is just possible. The distance an ion travels from the instant of voltage peak is $$x = \int_o^{\omega t} \frac{k^+}{\omega} E_o \cos t \, d(t) \quad (35)$$

or $$x = \frac{k^+ E_o}{\omega} \sin \omega t \quad (36)$$

To calculate a maximum frequency the gap spacing must be specified and equated with x. From the above formula we have $$f \frac{k^+ E_o}{2\pi d} \sin \omega t \quad (37)$$

Since the maximum time available before the voltage reverses is a quarter of a period, at $t=\pi/2$ the maximum frequency is $$f_{max} = \frac{k^+ E_o}{2\pi d} \quad (38)$$

If the frequency is constant, the maximum distance $d_{max}$, is given by $$d_{max} = \frac{k^+ E_o}{2\pi f} \quad (39)$$

When the field frequency is below $f_{max}$ the breakdown mechanisms are similar to those of the static field. There is a critical frequency $f_c$ which is specified by the ability of ions to travel the distance between the electrodes during a half-cycle. This frequency, $f_c$, is equal to twice $f_{max}$. It is, therefore, given by $$f_c = \frac{k^+ E_o}{\pi d} \quad (40)$$

When $f > f_{max}$ but lower than $f_c$, the breakdown mechanism may be modified by the longer presence of part of the positive ion space charge.

This could be augmented by a new avalanche produced in the opposite direction. Here a certain probability exists that the avalanche triggering the breakdown sequence may be smaller than that required in the static field. It may be produced by a lower voltage.

A slight reduction in the breakdown voltage at $f_{max} < f < f_c$ can be expected.

When $f > f_c$ that the ion space charge will oscillate between the electrodes. New avalanches will cause it to grow until instability and breakdown occur. Because of this cumulative effect breakdown will occur at lower fields than those at static voltages.

DESCRIPTION OF THE PREFERRED FORM

The preferred embodiment utilizes the known works of L. Malter, Paetow, Jacobs and their associates, for producing what is generally known as the Malter-effect. It is generally accepted that small amounts of insulating substances, usually oxides, can be applied to electrode or cathode surfaces to actively liberate electrons. The most effective substances generally are found to be MgO, $Al_2O_3$, and $SiO_2$. These and similar substances yield lower threshold potentials, and provide triggering electrons by either field emission or the Malter-effect once an initial breakdown charges them with positive ions.

A plasma environment can be generated for a given power source, mode of coupling, and device geometry. Our presently preferred embodiment uses alternating currnt as the power source, the coupling mechanism is capacitive, and the plasma environment is one of pressure. Capacitively coupled discharges like ours do not have electrodes in direct contact with the gaseous plasma. They are referred to as electrodeless discharges.

The electrodes are physically separated from the plasma region by a nonconductive wall. This wall is a dielectric barrier which is in direct contact with the electrodes on one side and the plasma region on the other. The electrical field in the plasma region is caused by oscillating electrostatic charges at the dielectric barrier surfaces. A high voltage oscillating power supply is required to permit a displacement current to pass through the barrier material.

The characteristics of our preferred embodiment use as a minimum a dielectric strength not less than 10 kv/mm, a minimum dielectric constant of not less than 9.7 kHz, and a maximum use temperature under no load conditions of at least 1500 degrees Centigrade, a minimum thermal conductivity of at least 0.05 at 20 degrees centigrade, and all other characteristics matching or exceeding those of Kyocera Ceramics A-476.

The combined use of the dielectric, with greater power, allows a minimum gap in our preferred embodiment of 0.330 cm. This allows for increased flow or volume of air, gases, or particulates to pass through the glow discharge or plasma. The preferred embodiment allows for use of a varying number of plates or discs as described, depending on the number desired for differing result. The preferred embodiment uses ten discs or plates in the assembly, as compared to twenty or more previously required for somewhat similar results.

The preferred embodiment allows for the transformer to power either two or three of the plate or disc assemblies, compared to a maximum of two previously.

The preferred embodiment allows for the mounting of a fan or blower with supporting hardware, but if sufficient air flow as determined by user engineers is present the fan or blower can be omitted.

This preferred embodiment uses only such switching as is required by laws or codes in that area or vicinity as the embodiment is installed requires. Generally the embodiment uses only a simple on and off control switch rated for electrical safety for the particular transformer and incoming power supply. Examples of the switches are supplied as prior art.

We have experimented with possible dielectric materials including Coors Ceramic high alumina $Al_2O_3$, under Coors' model designations AD-94, AD-96, ADS-995, ADS-996, and ADS-997. We have also experimented with Kyocera Ceramics company products. They include models designated A-410, A-440, A-445, A-473, A-476, A-479, A-479SS, A-480, A-490, and A-500 for their high alumina products. We will experiment with other Kyocera products including their dielectrics known as Fosterite, Steatite, Zircon, Spinel, Mullite, or Multiform glass.

The preferred embodiment must have increased electrical, thermal, chemical, and mechanical characteristics over those previously used in U.S. pat. No. 4,037,268 which was the Coors AD-96. Therefore, the preferred embodiment could use A-476, A-479, A-479SS, ADS-995, ADS-996, or ADS-997. Most of our results came from experimental units using A-476 or A-479.

The preferred embodiment utilizes the increased characteristics of the dielectric to allow the use of higher power transformers, increased gap between dielectric surfaces with a minimum gap of 0.330 centimeters, and it allows direct contact with air or undesirable gases with the dielectric surfaces.

The preferred embodiment utilizes a rectangular base or platform of a metal mesh or slotted metal suitably rigid for mounting multiple transformers and electrode plate or disc assemblies. The base or platform must allow for the easy and quick exchange of different size and weight transformers without drilling additional holes for mounting. The base or platform must also be suitable for dissipating heat from the transformer. The transformer minimum power will be 7,000 volts, 30 milliamps, and be midpoint grounded balanced.

CONCLUSIONS, RAMIFICATIONS AND SCOPE OF INVENTION

We have experimented with a large number of variables. These include varying gap distance between dielectric surfaces, variable dielectric materials, varying numbers of electrodes and their dielectric surfaces, varying power transformers up to 50,000 volts, and variable enclosures for use in other embodiments contemplated. The gap distance can easily be adjusted to 0.495, 0.660, 0.825, or 0.990 centimeters if desired for different conditions or results, by using longer assembly rods if necessary.

Although the invention has been described with respect to a specific embodiment various modifications can be made without departing from the scope of the invention. While our above description contains many specificities, these should not be construed as limitations on the scope of the invention, but rather as an exemplification of one preferred embodiment thereof.

Many other embodiments are possible. For purposes of example we mind readers that the plasma environment can readily be altered by manipulation of externally controlled variables such as gas or air flow rate, direction, inlet temperature, frequency, current, increase in voltage level, or the presence or absence of a magnetic field.

Other variations of the preferred embodiment may include the use of enclosures, such as those based on the broad definitions outlined in the National Electrical Manufacturer's Association standards types 1 through 13, or the use of varying power controls such as potentiometers. Variations of the preferred embodiment may include the use of direct or remotely connected sensor controls, designed to react with power fluctuations, reduced or increased air or gas intake, or humidity levels.

Other embodiments may include the use of or combination of sensors to detect and react to static electricity, gases including CO, $CO_2$, $H_2S$, methane, $SO_2$ or $NO_x$, or other that may be encountered. Various embodiments of this invention may be used in varying ways, sizes of the units or systems, or combinations thereof.

Examples include embodiments that might be used with the smallest electrode assembly of two electrodes with their dielectric covering, plus required means for applying the electrical potential. These uses may include alternative installations include on board vehicles, i.e. cars, trucks, planes, ships, or for very small interiors.

Other embodiments may utilize a large number of electrode assemblies. We have been asked to quote, for example, a company that uses coal for combustion in a boiler. Their boiler burns 960 tons of bituminous coal per day, and they desire an embodiment of our invention for releasing oxygen so as to aid in the boilers combustion. This particular test will use over 400 of the electrode plate or disc assemblies, and several hundred transformers, in one installation.

Other embodiments for possible use of the invention include the use in hospitals, laboratories, in manufacturing areas, i.e. glass manufacturing, foundries, textile plants, grain elevators, in mining operations, fuel storage areas or containers, in sewage treatment plants, university laboratories, and many others obvious to those skilled in the control of pollutants including particulates, gases, static, fuel combustion and emissions, microorganisms, germs, phage, odors.

We are experimenting anoder embodiment of this invention making it possible to submerge the electrode plate or disc assembly under water and other liquids. This embodiment shows promise in purifying water and other liquids.

Other embodiments suggested by previous uses of plasmas include but are not limited to embodiments used for plasma ashing, cleaning of metal surfaces, etching of inorganic surfaces, textile treatment, glow discharge grafting, plasma detoxification, removal of trace contaminants, and research opportunities including combustion and reacting flow to yield applications including the control of flue gas, soot, and other pollutants.

Other embodiments may be used to detoxify pesticides or hazardous waste. The classifications include organophosphorous pesticide, chlorinated hydrocarbon waste, brominated hydrocarbon rodenticide, heavy metal fungicide, chlorinated hydrocarbon pesticide, and polyaromatic red dye mixture. These include malathion, PCBs, methyl bromide, phenylmercuric acetate, kepone sylene azo-B-napthol, 1-methylaminanthraquinone, sucrose, graphite and silica binder, as all are known to react with plasmas.

We are currently seeking to apply embodiments of our invention for use in advanced coal utilization, fluidized bed combustion, combustion of coal and coal-based fuels in residential, commercial, industrial and utility coal fired furnaces. We also seek to apply embodiments of our invention in waste to energy plants, and in coal preparation, gas stream cleanup, flue gas cleanup, and waste utilization. We will test embodiments for simultaneous control of $SO_2$ and $NO_x$ in the combustion process, improved coal conversion process, gasification processes, and flue gas desulfurization and de$NO_x$ processes.

Our experiments show results not expected compared to those of U.S. Pat. No. 4,037,268 or U.S. Pat. No. 4,109,290. The dielectric surface irregularities of the formerly used materials could act as a micro point for arcing, sparkover, or streamers. The irregularities, the decreased characteristics, and decreased gap distance allowed deposits of moisture, dust or other deposits to form a track for arcing or sparkover. Dielectric breakdown made the use of the sealed chamber mandatory or required.

Our invention allows the use of half or fewer electrodes and dielectric surfaces. The assembly time and replacement time of the electrodes and dielectric surfaces is reduced commensurate with their decreased number. Our invention allows that one of the dielectric surfaces and electrode may be increased from parallel to to that of the adjoining electrode and surface, for increase angle of incidence, as it is commonly known in plasma physics. This may be used for additional generation of secondary electrons.

The combination of our claim in the preferred embodiment has been found by us to result in:

a. increased agglomeration of small and submicron particulates
b. increased breakdown and separation of undesirable gases, i.e. CO, $CO_2$, $SO_2$ amd $NO_x$
c. the release of oxygen, we believe resulting from plasma breakdown or glow discharge, and the excitation, dissociation and ionization of gases
d. increased particulate reduction of 5 microns or greater in size, from the former 78–92% average to a range of 88–99%.
e. reduced odors
f. reduced static
g. increased production of photons
h. and the sealed chamber described in U.S. Pat. No. 4,109,290 is no longer required or mandatory to prevent the production of ozone Through this embodiment a reduction of undesirable gases is achieved, and significant reductions can be obtained in both operating and investment costs.

Through this embodiment sufficient energy may be employed to cause ionization of neutral particles (molecules of oxygen, nitrogen and the like, particulates, etc.) which then become a part of the plasma thereby increasing the charged particle density of the plasma. The electron density of the plasma will vary with the actual conditions involved.

Accordingly, the scope of the invention should be determined not by the embodiments illustrated, but by the appended claims and their legal equivalents.

We claim:

1. An electrical discharge generator apparatus comprising:

at least two electrode units each having an electrically conductive plate such as stainless steel covered by a dielectric material bonded to the conductive plate, said electrode units being disc like in a spaced relationship, and said electrode units having an assembly notch, a tubular electrically conductive spacer and insulating washer, with the electrode units and spacer and insulating washer having an assembly rod capable of passing through the aligned spacers, washer, and electrode units, the rods being threaded are fitted with nuts tightened to compress in a good physical and electrical contact, all being mounted and connected to a transformer which is then connected to a switch controlling the power to the transformer primary winding, wherein the improvement comprises the combination that includes:

a. the apparatus includes a plurality of electrode units each having an electrically conductive plate having a surface covered by a dielectric material wherein:
   said dielectric material shall have a minimum dielectric strength of 10 kilovolts per millimeter;
   said dielectric material shall have a minimum dielectric constant of 9.7 kilohertz;
   said dielectric material shall have a minimum thermal conductivity not less than 0.05 at 20 degrees centigrade;
   said dielectric material shall have a maximum use temperature under no load conditions of at least 1,300 degrees centigrade;
b. the apparatus include said electrically conductive plate covered by said dielectric material bonded together by a flexible water, heat, and corrosion resistant silicone adhesive;
c. said electrode units being spaced at least 0.330 centimeters apart;
d. said electrically conductive spacer being made of the same dielectric material used for the electrically conductive plate surface;
e. said washer being made from the same material used for said electrically conductive plate;
f. said transformer for supplying electrical power between said electrode units being sufficient to generate a glow type of discharge between said plates, said transformer having a minimum power rating of at least 7,000 volts at 30 milliamps when supplied with 110 volts at 60 hertz, and said transformer being midpoint grounded.

2. The electrical discharge generator of claim 1 wherein:

said electrode units being in a spaced relationship, with the electrode units being spaced at least 0.330 centimeters apart by insulating spacers; and said insulating spacers being used in multiple combinations for increased spacing between said electrode units; and said insulating spacers being made of the same dielectric material used for said electrically conductive plate facing surfacing.

3. The electrical discharge generator of claim 1 wherein: said transformer for supplying electrical potential between said electrode unit being sufficient to generate a glow type of discharge between said plates; and said transformer having a minimum alternating current power rating of at least 7,000 volts at 30 milliamps when supplied with 110 volts at 60 hertz current; and said transformer being midpoint grounded.

* * * * *